United States Patent [19]

Fetzer et al.

[11] Patent Number: 4,882,812

[45] Date of Patent: Nov. 28, 1989

[54] OPENING ROLLER FOR AN OPENING DEVICE OF AN OPEN-END SPINNING MACHINE

[75] Inventors: Gerhard Fetzer, Süssen; Eugen Bader, Birenbach, both of Fed. Rep. of Germany

[73] Assignees: Fritz Stahlecker; Hans Stahlecker, both of Fed. Rep. of Germany

[21] Appl. No.: 191,688

[22] Filed: May 9, 1988

Related U.S. Application Data

[63] Continuation-in-part of Ser. No. 88,973, Aug. 24, 1987, which is a continuation of Ser. No. 731,272, May 7, 1985, abandoned.

[30] Foreign Application Priority Data

May 12, 1984 [DE] Fed. Rep. of Germany ..... 3417707

[51] Int. Cl.[4] ..... D01B 1/00; D01G 15/12; D01H 7/882

[52] U.S. Cl. ..... 19/112

[58] Field of Search ..... 19/97, 112; 57/408

[56] References Cited

U.S. PATENT DOCUMENTS 761,470 5/1904 Gessner ..... 19/112

4,805,395 2/1989 Stahlecker et al. ..... 19/97

FOREIGN PATENT DOCUMENTS 3321236 12/1984 Fed. Rep. of Germany ..... 57/400

3532059 3/1987 Fed. Rep. of Germany ..... 57/400

*Primary Examiner*—Werner H. Schroeder

*Assistant Examiner*—Douglas E. Price

*Attorney, Agent, or Firm*—Barnes & Thornburg

[57] ABSTRACT

A method of manufacturing an opening roller assembly for an opening roller of an open-end spinning machine is provided. A hardened cylindrical sleeve made of a hardenable steel alloy has at least one circumferential groove formed in an outer cylindrical surface. After forming the at least one circumferential groove, the cylindrical sleeve includes a remaining wall section having a thickness no greater than 2.2 mm extending from the base of the cylindrical groove to an inner surface of the cylindrical sleeve. Circumferential ribs are formed when the circumferential grooves are formed. The ribs have a base thickness of no greater than 0.7 mm. The sleeve wall radial thickness is about 0.06–0.72 times the height of the circumferential ribs. The circumferential groove base width is about 2.5 to 3.5 times the base thickness of the circumferential ribs. Next, at least two axially extending grooves are formed in an axial direction across the cylindrical sleeve circumferential ribs, thereby forming combing teeth having fine tooth points and a slender shape for opening slivers into individual fibers.

2 Claims, 2 Drawing Sheets

III

FIG.7
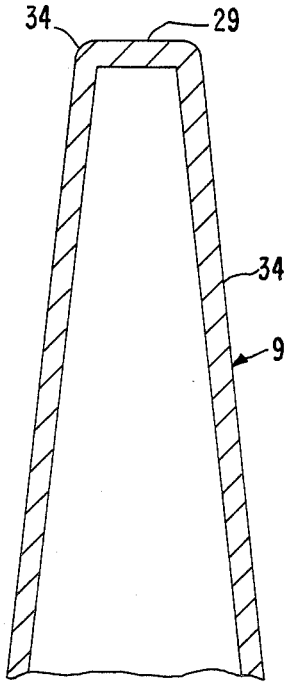
FIG.9
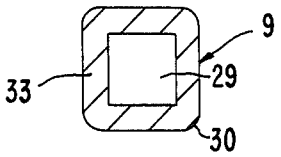
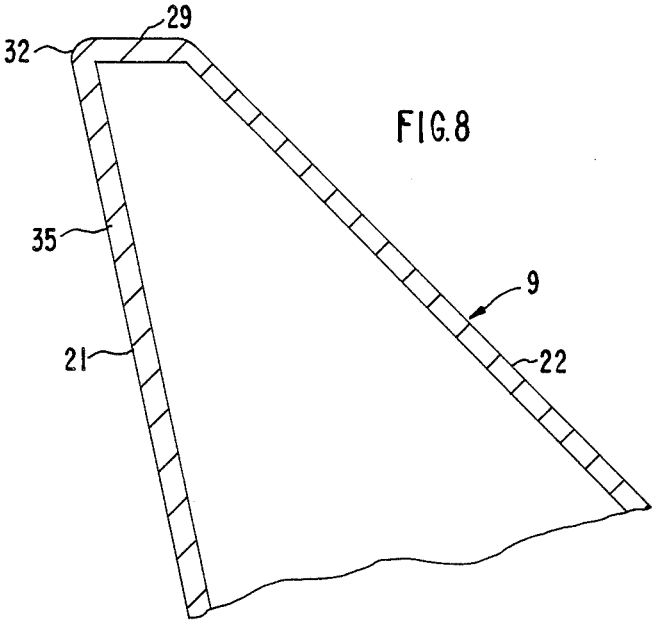
FIG.8

OPENING ROLLER FOR AN OPENING DEVICE OF AN OPEN-END SPINNING MACHINE

CROSS REFERENCE TO RELATED APPLICATION

This application is a Continuation-in-Part application of U.S. patent application Ser. No. 088,973, filed August 24, 1987, which is a continuation application of U.S. patent application Ser. No. 731,272, filed May 7, 1985.

BACKGROUND AND SUMMARY OF THE INVENTION

This invention relates generally to an improved opening roller for an opening device of an open-end spinning arrangement having a roller body that is connected to a shaft. More specifically, a ring mounting or fitting ring arranged on the roller body is provided with teeth on its circumference.

It is currently the practice to use opening rollers in open-end spinning arrangement having teeth in the form of a saw-tooth wire wound directly onto the roller body circumferential surface, or onto a ring mounting. The shape of the teeth has a considerable effect on the efficiency of the opening process and is designed in accordance with the fiber material to be processed. In order to protect the relatively fine teeth against mechanical damaging when the opening rollers are being handled during transportation or storage, collars are usually provided which are unitary with the part carrying the teeth, i.e., the ring mounting or the roller body.

DE-OS 19 39 683 discloses an opening roller of the type described above, wherein a ring mounting is provided which has teeth formed in one piece by the formation of at least one surrounding groove and several recesses extending in an axial direction. The ring mounting protrudes over the roller body on both sides in an axial direction. Due to the presence of axially extending recesses, it is not possible with this type of construction to mount collars at the ring mounting which can protect the teeth against mechanical damaging during transportation or storage. In this type of construction, the teeth must therefore be designed to be very strong, thereby presenting considerable limitations with respect to tooth shapes that can be used. Also, an obtuse vertical angle is provided between the tooth face and the back of the tooth. Because of these disadvantages, an opening roller of this type has not been in practice.

As discussed, the shape of the teeth has a considerable effect on the efficiency and effectiveness of the opening process. Further, the shape and dimensions of the teeth are very important in both achieving proper opening of slivers into individual fibers and preventing damage to the fibers, and this factor must also be balanced with teeth which are resistant to wear. During manufacturing of the rings for opening rollers, it is important to take into account all of the above factors, including shapes, dimensions and materials, as well as additional factors.

It is known to use saw-tooth wire for either card clothing, which forms slivers, or for opening rollers which open up slivers into individual fibers. The saw-tooth wire is wound around a support cylinder of some type. The saw-tooth wire is in the form of a strip having teeth cut out. On lateral faces of the wire, a projecting edge is provided such that when the saw-tooth wire is wound into a coil, abutting lateral faces will create circumferential grooves between rows of teeth. The methods involved in forming cylinders having teeth formed by saw-tooth wire are widely divergent from the methods of forming a solid ring having teeth. Further, certain additional factors must be considered with saw-tooth wire arrangements, such as a support structure disposed underneath the saw-tooth wire. On the contrary, solid rings support themselves, and thus do no require a supporting cylindrical inner element.

For increasing resistance to wear, hardenable materials such as steel alloys are desirable. However, the steel alloy has a greater mass than known aluminum arrangements. Thus, dimensions should be kept as low as possible such that the ring formed does not have an undesired high mass. Further, it is desirable to have an opening ring of a single material to facilitate any subsequent wear resistant coating applications. In certain prior arrangements, metal saw-tooth wire had been applied to an aluminum support. The different materials sometimes complicated subsequent coating processes.

As discussed above, the dimensions of an opening roller ring and the teeth arrangement thereon are highly critical for the specific purposes of opening up slivers into individual fibers. To form these highly specific dimensions required for a hardened steel alloy opening roller ring element and the teeth arrangement thereon, specific advantageous processes are needed.

It is thus an object of the present invention to provide a process of manufacturing an opening roller assembly, including the formation of a solid opening roller ring mounting or fitting ring having highly specific dimensions and teeth arrangement critical for the specific purpose of opening up slivers into individual fibers.

It is a further object of the invention to provide a method of manufacturing such a ring made of a hardenable steel alloy material, while keeping total mass as low as possible without sacrificing durability and resistance to wear.

It is a further object of the present invention to provide precision in the formation of very small, slender and fine teeth on an opening roller ring, as deformities in such a precise fine arrangement may hinder the opening process.

These objects and other objects are achieved by providing a method of manufacturing an opening roller assembly for an opening roller of an open-end spinning machine which includes forming at least one circumferential groove in an outer surface of a hardened steel alloy cylindrical sleeve. The circumferential groove creates circumferential webs having lateral flanks delimited by the circumferential grooves. A wall section is created in the cylindrical sleeve from which the circumferential ribs or webs extend outwardly. The radial thickness of the sleeve wall section should be no greater than 2.2 mm. The base thickness of the circumferential ribs should have a thickness of no greater than 0.7 mm. The sleeve wall radial thickness should be about 0.60–0.72 times the height of the circumferential ribs. The circumferential grooves should have a base width of about 2.5 to 3.5 times the base thickness of the circumferential ribs. Next, at least two axially extending axial or longitudinal grooves are formed across the cylindrical sleeve circumferential ribs, thereby forming combing teeth having fine tooth points and a slender shape for opening slivers into individual fibers on the outer surface of the cylindrical sleeve. The axial grooves form front and back faces on the teeth which have lateral flanks formed by the circumferential groove.

The hardened steel alloy material used for the ring provides superior wear resistance. The maximum thickness of the ring wall of 2.2 mm provides a metal ring that does not have too high of a mass. Further, as the steel alloy is hardened, the teeth are uniformly hard over their entire height and thickness, as well as in the area where the teeth extend from the sleeve wall. This results in much improved wear characteristics. By using already hardened steel alloy for the ring, precisely formed teeth can be formed without requiring a subsequent hardening which may deform teeth.

According to advantageous features of certain preferred embodiments of the invention, the circumferential grooves and the axial grooves are ground into the hardened steel alloy sleeve. Although it is preferable to only use grinding, it is also possible to first cut the circumferential groove by way of turning or a lathe, and then subsequently gring the groove. As the circumferential ribs formed by the circumferential grooves are so thin (no greater than 0.7 mm in the base region), grinding is the best method as it forms precise rib dimensions required in the area of opening roller art.

Further, as the axial grooves are formed in the very fine and thin circumferential ribs, grinding is the most appropriate process to be used. Grinding provides the precise and delicate dimensions of the teeth of the opening roller ring. The grinding of the ring element provides very good concentricity and does not require an expensive balancing process of the ring element after the teeth have been formed. The ring element will be subjected to extremely high speeds of rotation such as velocities of about 3,000 to 12,000 $min^{-1}$. To ensure accuracy and to assure smooth operation with reduced noise, the rings should be properly balanced when rotated. The present invention process produces a ring element of such precision that the produced ring element is already balanced without requiring a subsequent balancing operation.

The grinding of the grooves provides high surface qualities along with the precise dimensions required in opening roller construction.

In certain preferred embodiments, the ring mounting has a hardness of about HRc60+3.

According to other advantageous features of certain preferred embodiments of the invention, the teeth of the ring mounting are electrolytically or chemically deburred (etched) after the grooves are formed. This process is not merely a removal of burrs from the surface of the teeth, but precisely rounds off by cutting or etching the sharp edges of the teeth formed during the grinding steps. These rounded off edges are highly desirable for opening roller teeth to provide the most efficient and effective opening up of a sliver into individual fibers without damaging the fiber material. In certain preferred embodiments, the edges of the teeth are rounded off such that they have a radius of curvature in the range of 0.02 mm to 0.06 mm. In certain preferred embodiments, the radius of curvature of the rounded edges should be about 0.04 mm.

According to other advantageous features of certain preferred embodiments of the invention, the ring mounting, at least in the area of the teeth, is provided with a surface coating after the shaping of the teeth. Examples of suitable chemical coating include a diffusion treatment with nitrogen and carbon, or a metallic coating. Especially preferred is a coating which includes a chemically applied nickel layer with embedded diamonds. The wear resistance of the opening rollers can be improved, especially in the area of the teeth when a surface coating is applied to the already relatively hard steel alloy base.

Other objects of the present invention include providing an opening roller which is not subject to limitations with respect to the development and design of the teeth which may be broken off subsequent to forming. This object and other objects are achieved by bordering the ring mounting on each side with collars extending in the radial direction to approximately the tops of the teeth. These collars are mounted on that portion of the roller body that axially projects beyond the ring mounting on both sides. By means of these collars, teeth that are integral with the ring mounting are protected so that very finely shaped teeth can be used without danger of being damaged.

According to other advantageous features of certain preferred embodiments of the invention, at least one of the collars is detachably mounted on the roller body. This makes it possible to replace the ring mounting, thereby reconstructing the opening roller. By means of the detachable collar, it is also possible to clamp the ring mounting so tightly to the roller body that it is held securely in place.

According to other advantageous features of certain preferred embodiments of the invention, at least two surrounding grooves that are sloped in opposite directions and cross one another are formed into the ring mounting. This results in very finely shaped teeth having a very good combing effect.

According to advantageous features of certain preferred embodiments of the invention, the ring mounting is equipped with surrounding grooves that are sloped in opposite directions and extend from the axial center of the ring mounting. This makes it possible to position the fiber material (sliver) to be opened up in a desirable distribution over the working surface of the opening roller; i.e., to concentrate the fiber in the direction of the center of the working surface.

Other objects, advantages and novel features of the present invention will become apparent from the following detailed description of the invention when considered in conjunction with the accompanying drawings.

BRIEF DSESCRIPTION OF THE DRAWINGS

FIGS. 7–9 are magnified front, side and top view respectively of the rounded portions of teeth according to certain preferred embodiments of the invention.

DETAILED DESCRIPTION OF THE DRAWINGS

Figure 1:
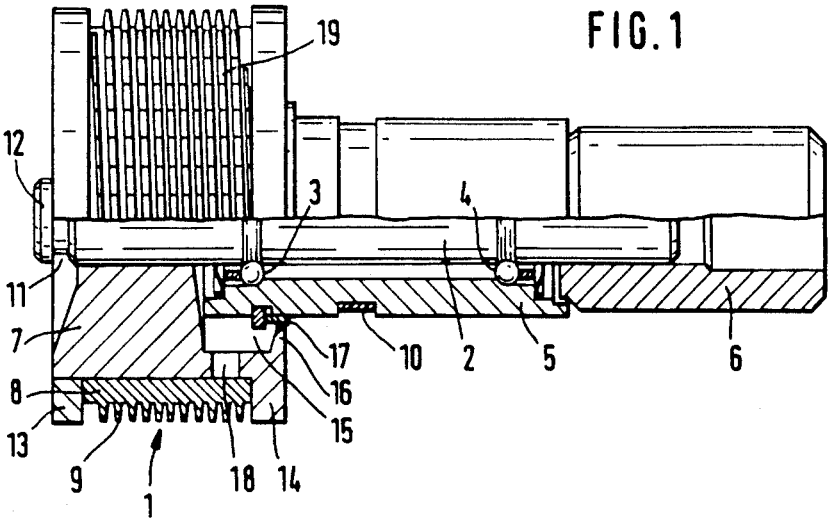
FIG. 1 is a partial cross-sectional view of an opening roller having a roller body connected with a shaft and a ring mounting arranged on it in accordance with certain preferred embodiments of the present invention.

The opening roller corresponding to FIG. 1 is used in open-end spinning units. It has the purpose of combing out a sliver supplied to it by a feeding device, thereby opening up the sliver into individual fibers. It is usually driven at a rotational velocity of between 5,000 and 12,000 $min^{-1}$.

The opening roller assembly 1 as shown in FIG. 1 includes a roller body 7 connected to a shaft 2. The shaft 2, by means of two ball bearings 3 and 4 is disposed in a cylindrical bearing housing 5, allowing the ball bearings 3 and 4 to run against the shoulders of the bearing housing 5. At one end, it is provided with a pressed-on wharve 6, by means of which the shaft 2 can be driven by a tangential belt in a manner that is not shown in detail. The other end of the shaft 2 carries the basic body 7 of the opening roller 1 which is pressed onto the body. At its outer front side, the roller body 7 is provided with a conical depression 11 into which the end of the shaft 2 projects. The end of the shaft 2 is equipped with a hub 12 bordered by a ring groove. The hub 12 serves as a working surface for a tool for removing the whole opening roller 1, together with the shaft 2 and the bearing housing 5 from the spinning unit. The bearing housing 5 is equipped with a plastic ring 10 located in a ring groove. A fastening element of an opening roller housing (not shown) engages the plastic ring 10, and thus secures the bearing housing 5 in the opening roller housing.

In a rotationally stable manner, a ring mounting (fitting ring) 8 is arranged on the outer circumference of the roller body 7. The outer circumference of the ring mounting is equipped with teeth 9 for combing-out of the sliver, thereby opening the sliver into individual fibers. The ring mounting 8 is connected with the roller body 7 so as to preclude relative rotation between the mounting and the roller body; e.g., by being pressed on. The ring mounting 8 is arranged between two collars 13 and 14. The collar 14 is designed to be unitary with the roller body 7, while the collar 13 is a detachable ring, such as a clamping ring which is fastened on the roller body 7. It is also contemplated that the collar is alternatively pushed onto the roller body 7 with a press fit. In certain preferred embodiments, the collar is also provided with an internal screw thread and is screwed onto a corresponding external thread of the roller body 7. In this manner, it is contemplated that the collar may be connected with the roller body 7 in such a way that the ring mounting 8, which is pushed onto the roller body 7 with a relatively easy sliding fit, is connected with the roller body 7 in a rotationally stable manner; i.e., in a manner which precludes relative rotation.

The roller body 7, having an axial projection, reaches over the end of the bearing housing 5, forming a hollow space 15. The projection extends over the bearing housing 5 with an inwardly protruding projection 16 aimed in the direction of the bearing housing 5. A ring insert 17 is pushed onto the bearing housing 5 and is fastened by means of a locking ring. The ring insert 17, together with the projection 16, forms a sealing gap by means of which the hollow space 15 is sealed off from the outside. In the area of the axial projection of the roller body 7 that is covered by the ring mounting 8, several radial bores 18 are provided leading to the hollow space 15. When the ring mounting 8 is removed, the bores 18 are therefore freely accessible so that the hollow space 15 may be cleaned, for example, by being blown out with compressed air.

The teeth 9 are unitary with the ring mounting 8; i.e., the ring mounting 8 comprises a cylindrical sleeve, the outer circumference of which is machined in such a way that the teeth 9 are formed therein. A material that is hardenable by heat treatment (preferably a steel alloy) is used for the sleeve which forms the ring mounting 8 and the teeth 9. In accordance with the particular use and the requisite surface hardness, it is contemplated to use different types of steel, as well as very high alloy tool steel types. However, other materials may also be used, such as those that are very hard from the start, including hard metal.

Figure 3:
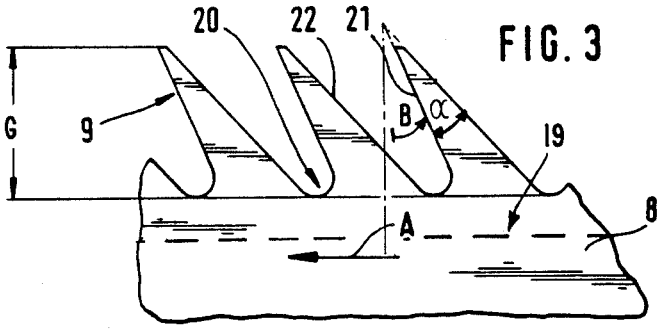
FIG. 3 is a partial view of FIG. 2 in the direction of arrow III.

The teeth 9 are shaped into the outer circumference of the sleeve forming the ring mounting 8 by forming a surrounding, circumferential spiral groove 19 into the surface in accordance with the embodiment according to FIG. 1. In addition, recesses (axial grooves) 20 are formed in the exterior surface of the sleeve. These recesses are aimed in the an axial direction across the circumferential grooves 19 and extend substantially in parallel to the axis of the sleeve while forming the front surfaces 21 and the rear surfaces 22 of the teeth 9 (FIG. 3).

Figure 4:
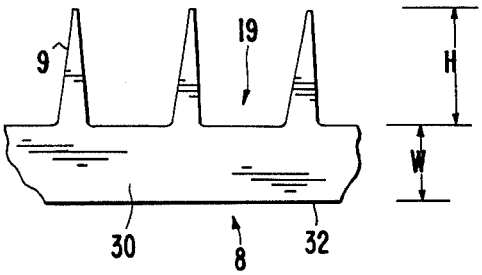
FIG. 4 is a side view of a section of a ring mounting according to certain preferred embodiments of the invention.
Figure 5:
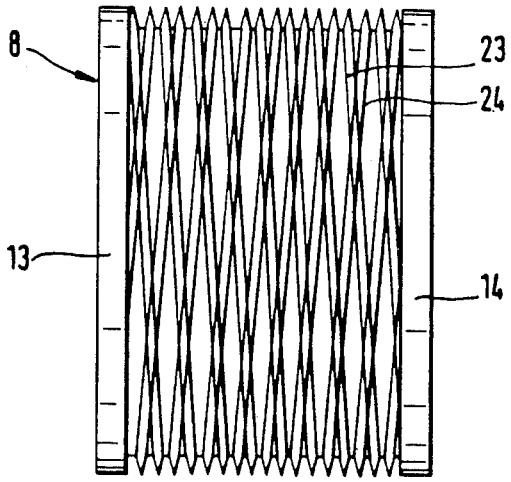
FIG. 5 is a side view of a roller body having a ring mounting into which surrounding grooves that cross one another are formed.

Preferably, the material for the ring mounting 8 is an alloyed steel that can be hardened to HRc 60+3. In this case, it is provided that first the circumferential spiral grooves 19 (other types of circumferential grooves are shown in FIGS. 4 and 5) are worked into the ring mounting 8 after the ring mounting 8 has been hardened. The forming of the circumferential grooves form circumferential ribs or webs in the ring mounting.

In certain embodiments, these grooves 19 are preferably formed by means of a lathe, employing a precision-turning or diamond-turning, followed by grinding to provide the precise shape required. However, a preferred method for forming the circumferential grooves is by grinding into the circumferential ribs formed on the ring mounting without any prior cutting or turning. The ribs formed are so fine and thin, as will be discussed in the dimensions below, that a grinding process subsequent to hardening provides the best results. A subsequent hardening process after forming the grooves may lead to deformation of the teeth. The grinding into the outer circumference of the sleeve provides extremely accurate dimensions and precise thin webs which are required in the area of opening roller art. This precision is required, both in the dimensions of the teeth formed and in the concentricity of the entire ring element.

After forming the circumferential grooves 19, the axial grooves 20, which extend in parallel to the axis of the ring, are formed by grinding, thereby creating the front surfaces 21 and the rear surfaces 22 of the teeth 9. The axial grooves 20 are ground into the circumferential ribs. As with the forming of the ribs, the very fine and precise teeth may be deformed if formed prior to hardening of the steel alloy and subsequently subjected to hardening. Thus, the axial grooves should be also ground into circumferential ribs when the steel alloy is hardened. Further, as the circumferential ribs are so thin, grinding is extremely important in forming the axial groove such that the ribs and the subsequently formed teeth are not damaged during the process. Further, grinding provides precise finished dimensions of the teeth, as well as superior concentricity of the entire ring element.

As shown in FIG. 3, the teeth 9 are formed with very fine points and narrow shapes which is rendered practical because of the ring mounting 8 being protected by the collars 13 and 14 when assembled. The collars 13 and 14 eliminate the danger of a mechanical breakage or other damage which would otherwise occur during routine transportation and storage. Further the ring mounting 8 and the integral teeth are made of a hardened steel metal alloy, further reducing the possibility of breakage.

The preferred dimensions formed by the groove grinding processes are discussed below. These dimensions provide optimum opening characteristics for opening a sliver into individual fibers without damaging the fibers. These dimensions also are the most advantageous for the entire fitting ring element for use in an opening roller assembly, which will be subjected to high rates of speed such that the mass should be kept low and the ring should be concentric and well balanced. A lower mass is also desirable for convenience of use and optimum operability of the entire opening assembly. The methods discussed above provide these optimum dimensions and concentricity which renders a subsequent balancing step unnecessary.

The base of the teeth at the lateral flank formed by the circumferential grooves 19 should have a thickness B no greater than 0.7 mm. The width U of the base of the circumferential grooves 19 should be approximately 2.5–3.5 times greater in value than the thickness B of the base of the teeth. As shown in FIG. 4, the wall 30 of the fitting ring 8 from which the teeth project should have a thickness W of no greater than 2.2 mm. Thus, in forming the circumferential grooves 19, the area extending from the interior surface 32 of the ring 8 to the base of the circumferential grooves 19 should be no greater than 2.2 mm. This maximum thickness W of 2.2 mm is very critical. In the present invention, the fitting ring 8 is made of a hardenable steel alloy to increase resistance to wear and to provide strong supporting material for the finely shaped teeth which are most advantageous for opening slivers into individual fibers. Often, supporting rings which are required in saw-tooth arrangement have been made of aluminum, and thus dimensions could be larger due to the lightweight aluminum material.

As discussed above, for purposes of resistance to wear, best tooth shaped and facilitating coating of a uniform base material, the present invention utilizes a solid integral fitting ring made entirely from steel alloy. Thus, the mass of the ring is a concern due to the increased mass of steel alloy with respect to aluminum. To optimally decrease the mass of the ring and still provide a durable optimally operable ring, it was found to be advantageous to keep the wall thickness W below 2.2 mm.

Figure 2:
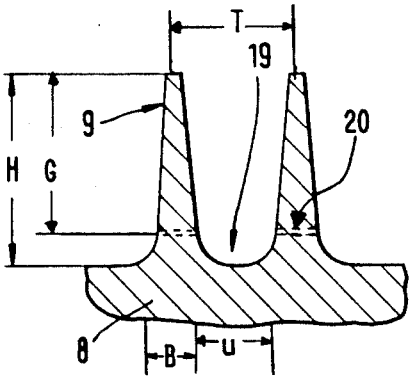
FIG. 2 is an enlarged partial section through the ring mounting of FIG. 1.

As shown in FIG. 4, the ratio of the fitting ring wall thickness W and the height H of the teeth 9, measured from the base of the circumferential grooves 19, should be in the range of 0.6–0.72. As shown in FIGS. 2 and 3, the height G of the teeth 9 from the base of the axial grooves 20 is approximately 0.75–0.80 times the height H of the teeth measured from the base of the circumferential grooves 19.

Further, an angle $\alpha$ between the front and back surfaces of the teeth 21, 22 should be in the range of 15° to 45° in certain preferred embodiments. In addition, a relatively large face angle $\beta$ is provided which plays a considerable role for the opening-up of the fiber material. It is contemplated that the angle $\beta$ has values of between 12° and 25° . The face angle $\beta$ is the angle between a radial surface (a surface perpendicular to the axis and passing through the top point of a tooth) and the front face 21.

After the surrounding, circumferential grooves 19 and the axial grooves 20 are formed, the ring mounting 8 is treated electrolytically or chemically, such that a deburring of the edges of the teeth 9 takes place, rounding them off slightly. This electrolytical or chemical step not only removes any burrs formed during the groove making steps, but also rounds off the edges of the teeth by etching or cutting to provide optimum opening up of a sliver into individual fibers with a reduced chance of damage to the fibers. This electrolytical or chemical step cuts off sharp edges formed during the groove making steps.

As shown magnified in FIGS. 7–9, this electrolytical or chemical step rounds off the front faces 21, the rear faces 22 and a tip area 29 as shown by rounded edges 30, 31, 32, 33, 34 and 35.

In certain preferred embodiments, the electrolytically or chemical step rounds off the edges of the teeth such that the edges have a radius of curvature of about 0.02 mm to 0.06 mm. In certain preferred embodiments, this radius of curvature is 0.04 mm.

In the embodiment according to FIG. 5, two circumferential spiral grooves 23 and 24 are worked into the ring mounting 8 arranged between the two collars 13 and 14. These circumferential spiral grooves extend in opposite directions to one another and cross one another. The result is a very fine, more irregular distribution of teeht so that an improved combing-out and opening-up of a sliver becomes possible.

Figure 6:
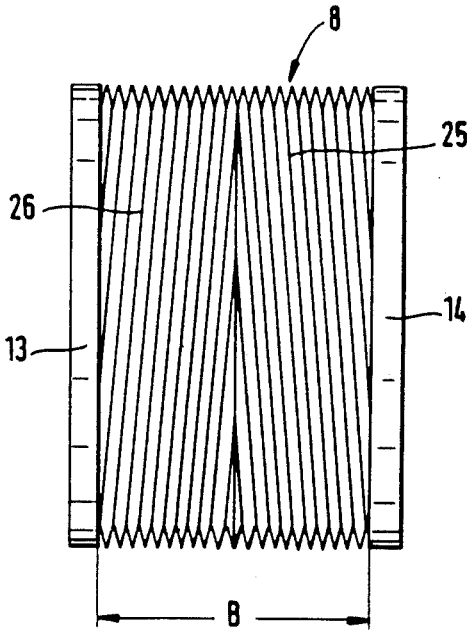
FIG. 6 is a side view of a roller body having a ring mounting with surrounding grooves that extend in opposite direction from one another and extend from the axial center.

In the embodiment according to FIG. 6, starting from the axial center of the ring mounting 8, two circumferential grooves 25 and 26 are worked into this ring mounting 8, one of which is inclined toward the left. By means of such an arrangement of the spiral grooves 25 and 26, and of the teeth 9 of the opening roller 1 bordering on it, and by means of the selected rotating direction (FIG. 4, arrow a), the distribution of the sliver is controlled during the combing-out. For example, the sliver can be positioned more toward the center of the working area B between the two collars 13 and 14.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An opening roller for an open-end spinning arrangement, comprising:

roller body means, shaft means connected to said roller body means for rotating said roller body means, ring mounting means arranged on said roller body means for combing sliver, said ring mounting means having a cylindrical outer surface, said surface of said ring mounting means having a plurality of combing teeth, said teeth being unitary with said outer surface, said teeth being formed by a plurality of circumferential grooves and a plurality of axially extending recesses in said outer surfaces, and first and second roller collar means mounted on said roller body means at each end for protecting said teeth, said collar means extending radially at least as far as said outer surface of said ring mounting means, at least one of said circumferential grooves being contained in a first plane sloped in a direction toward said first collar means and at least one of said circumferential grooves being contained in a plane sloped in a direction toward said second collar means.

2. A ring mounting removably mountable on a roller body of an opening roller for an opening device of a spinning arrangement comprising cylinder means having a cylindrical outer surface, said outer surface having a plurality of combing teeth, said teeth being unitary with said outer surface, said teeth being formed by a plurality of circumferential grooves and a plurality of axially extending recesses in said outer surface, at least one circumferential groove being contained in a first plane sloped in a direction toward a first end of said cylinder means and at least one circumferential groove being contained in a plane sloped in a direction toward another end of said cylinder means.

* * * * *